US005932402A

United States Patent [19]

Schütz et al.

[11] Patent Number: 5,932,402

[45] Date of Patent: Aug. 3, 1999

[54] COLOR PHOTOGRAPHIC RECORDING MATERIAL WITH IMPROVED MECHANICAL PROPERTIES AND IMPROVED STABILITY IN A TROPICAL CLIMATE

[75] Inventors: Heinz Schütz, Leverkusen; Rainer Scheerer, Köln; Klaus Sinzger, Leverkusen, all of Germany

[73] Assignee: Agfa-Gevaert AG, Germany

[21] Appl. No.: 08/991,703

[22] Filed: Dec. 16, 1997

[30] Foreign Application Priority Data

Dec. 19, 1996 [DE] Germany ..... 196 52 956

[51] Int. Cl.[6] ..... G03C 7/30; G03C 1/46

[52] U.S. Cl. ..... 430/505; 430/506; 430/507; 430/517; 430/522; 430/519; 430/518; 430/520; 430/521

[58] Field of Search ..... 430/506, 505, 430/517, 522, 519, 518, 520, 521, 507

*Primary Examiner*—Janet Baxter
*Assistant Examiner*—Amanda C. Walke
*Attorney, Agent, or Firm*—Connolly & Hutz

[57] ABSTRACT

A colour photographic recording material, comprising of a transparent film base, red-sensitive, green-sensitive and blue-sensitive silver halide emulsion layer units which are disposed thereon and which contain colour couplers, and optionally of further light-insensitive layers, wherein the green-sensitive silver halide emulsion layer unit comprises at least two green-sensitive partial layers, the partial layer of which which is furthest from the film base has the highest sensitivity and is situated further from the film base than is each partial layer of the red-sensitive silver halide emulsion layer unit, and wherein each partial layer of the blue-sensitive silver halide emulsion layer unit is situated further from the film base than is the highest-sensitivity partial layer of the green-sensitive silver halide emulsion layer unit, contains, in the highest-sensitivity partial layer of the green-sensitive silver halide emulsion layer unit, an organic yellow dye which can be decolorised during processing; the light-insensitive binder layer adjacent thereto on the side remote from the film base contains no silver halide development nuclei and contains substantially no dye which can be decolorised during processing.

16 Claims, No Drawings

COLOR PHOTOGRAPHIC RECORDING MATERIAL WITH IMPROVED MECHANICAL PROPERTIES AND IMPROVED STABILITY IN A TROPICAL CLIMATE

This invention relates to a colour negative film without the yellow filter layer which is otherwise customary.

Colour photographic recording materials (colour films) usually contain at least one blue-sensitive layer, at least one green-sensitive layer and at least one red-sensitive layer on a transparent film base. In colour negative films, blue-sensitive layers are generally situated furthest from the film base, followed by a yellow filter layer which is decolorised by the processing procedure, and followed then by green-sensitive and red-sensitive layers in succession (as seen in the direction of the film base). The yellow filter layer is absolutely necessary in order to reduce the blue-sensitivity of the green- and red-sensitive silver halide emulsion layers. This is usually effected by an amount of 0.6–1.2 logarithmic units of the blue-sensitivity. The dye which is used for the yellow filter is either colloidal silver, which is removed by the bleaching step of the processing operation, or is an organic dye which is fixed in the filter layer but which is dissolved out of the film by processing, in that, for example, it is readily water-soluble in the alkaline medium of the developer, in contrast to the neutral medium of the layer structure.

Colloidal silver as a yellow filter dye has two disadvantages: the first is the promotion of physical development by silver ions on the silver grains, due to which, as a result of the formation of oxidised developer, colour fogging occurs and the durability of films is impaired if they are stored in hot, humid conditions; the second is the high absorption in regions other than the desired spectral region, which mainly occurs at the cost of the green-sensitivity.

Organic dyes do not possess these disadvantages, which is why attempts have been made to use them instead of colloidal silver. There are some difficulties which stand in the way of this, however. These arise firstly due to the requirement of spatial fixation within the film and secondly due to the need for a good capacity for decolorisation in the processing procedure. Under hot, humid conditions, dyes with a good capacity for decolorisation have a tendency to become distributed over the entire film. This results in a loss of blue-sensitivity because the blue-sensitive layer is coloured yellow, and results in a loss of colour reproduction quality because part of the dye is no longer situated above the green-sensitive layer. The necessity of spatially fixing the yellow dye makes it essential that this is accommodated in a capacious matrix. This means that the yellow filter layer cannot be made as thin as would be desirable for other reasons. In particular, the thinner the layer structure above the green-sensitive layer, the better is the sharpness of a colour film. Reasons of mechanical stability also make it essential that the dye is embedded in a not inconsiderable amount of binder. If the volume fraction of binder in the yellow filter layer is considerably reduced, the dry adhesion of this layer is lost, which is absolutely prohibitive for a colour negative film.

The object of the present invention is to obtain a colour negative film with a sharpness which is as high as possible, good stability on storage under hot, humid conditions, and good mechanical properties.

The present invention relates to a colour photographic recording material comprising a transparent film base, a red-sensitive silver halide emulsion layer unit with which at least one colourless cyan coupler is associated, a green-sensitive silver halide emulsion layer unit with which at least one colourless magenta coupler is associated, a blue-sensitive silver halide emulsion layer unit with which at least one colourless yellow coupler is associated, and optionally further light-insensitive layers, wherein the green-sensitive silver halide emulsion layer unit comprises at least two green-sensitive partial layers, the partial layer of which which is furthest from the film base has the highest sensitivity and is situated further from the film base than is each partial layer of the red-sensitive silver halide emulsion layer unit, and wherein each partial layer of the blue-sensitive silver halide emulsion layer unit is situated further from the film base than is the highest-sensitivity partial layer of the green-sensitive silver halide emulsion layer unit, characterised in that the highest-sensitivity partial layer of the green-sensitive silver halide emulsion layer unit contains an organic yellow dye which can be decolorised during processing.

Each of said silver halide emulsion layer units optionally comprises of at least two silver halide emulsion partial layers of the same spectral sensitivity, of which the partial layer with the highest sensitivity is generally situated furthest from the film base, wherein the recording material contains at least one colourless colour coupler in spatial association with each partial layer. In particular, the green-sensitive silver halide emulsion layer unit comprises two, three or more green-sensitive silver halide emulsion partial layers, the highest-sensitivity partial layer of which is situated further from the film base than are all the other partial layers of the green-sensitive silver halide emulsion layer unit, and is also situated further away than are all the partial layers of the red-sensitive silver halide emulsion layer unit. The partial layers of a silver halide emulsion layer unit are preferably adjacent to each other. However, they can also be separated from each other, subject to the above prerequisites, by one or more partial layers of another silver halide emulsion layer unit and by intermediate light-insensitive layers which may possibly be necessary.

The term "spatial association" is to be understood to mean that the colour coupler is situated in a spatial relationship with respect to the respective partial layer such that an interaction between them is possible which permits image-by-image correspondence between the silver image formed on developing and the colour image formed from the colour coupler. In general, this is achieved by the colour coupler being contained in the respective partial layer itself or in a layer adjacent thereto, which may be a further partial layer of the respective silver halide emulsion layer unit or optionally an adjacent, light-insensitive layer. If partial layers of the same silver halide emulsion layer unit are directly adjacent to each other, each of them does not necessarily have to contain a colour coupler.

The term "spectral association" is to be understood to mean that the spectral sensitivity of the respective light-sensitive silver halide emulsion partial layer and the colour of the partial colour image produced from the spatially associated colour coupler are in a defined relationship to each other, wherein in the present case a complementary partial colour image (cyan, magenta, yellow) is associated with the spectral sensitivity of each separate chromatic component (red, green, blue). Thus at least one colourless magenta coupler is associated with the green-sensitive silver halide emulsion partial layers.

A light-insensitive binder layer is adjacent to the highest-sensitivity partial layer of the green-sensitive silver halide emulsion layer unit on the side remote from the film base. This binder layer acts solely as a separating layer between the highest-sensitivity partial layer of the green-sensitive silver halide emulsion layer unit on the one hand and the blue-sensitive silver halide emulsion layer unit one the other hand. In conventional colour films there is at least one yellow filter layer, i.e. a layer which contains yellow colloidal silver or a yellow organic dye, between the uppermost green-sensitive layer and the lowermost blue-sensitive layer in the composite layer structure. A light-insensitive layer such as this is omitted in the colour photographic recording material of the present invention. In all cases, the present light-insensitive separating layer between the highest-sensitivity green-sensitive partial layer and the lowermost blue-sensitive layer contains no silver halide development nuclei, and in particular contains no colloidal silver, and also contains substantially no organic dye which can be decolorised during processing (yellow filter dye).

In contrast, an organic yellow dye which can be decolorised during processing is contained in the highest-sensitivity partial layer, which is furthest from the film base, of the green-sensitive silver halide emulsion layer unit.

Suitable organic yellow filter dyes have an absorption maximum between 400 nm and 500 nm, and generally correspond to one of the classes of dyes which are characterised by formulae I–V:

$$A^1{=}L^1{-}A^2 \quad (I)$$

$$A^1{=}L^1{-}L^2{=}B^1 \quad (II)$$

$$A^1{=}L^1{-}A \quad (III)$$

$$A^1{=}N{-}Ar \quad (IV)$$

$$A^1{-}N{=}N{-}Ar \quad (V)$$

where $A^1$ and $A^2$ (identical or different): represent acidic radicals $B^1$ represents a basic heterocyclic radical;

Ar represents a carbocyclic aromatic group or an unsaturated heterocyclic ring $L^1$ and $L^2$ (identical or different); represent unsubstituted or substituted methine groups.

The acidic radicals represented by $A^1$ and $A^2$ are to be understood to be radicals of open-chain or cyclic, C—H-acidic ketomethylene compounds. Examples of open-chain ketomethylene compounds of this type include malononitrile, aroylacetonitrile and arylsulphonyl acetonitrile. Examples of cyclic ketomethylene compounds include 5(4H)-pyrazolone, 5(4H)-isoxazolone and 2(5H)-furanone. Other examples of acidic radicals can be found in RD 36544 (September 1994), page 511.

Examples of the basic heterocyclic radical represented by B include oxazole, thiazole, 3H-pyrrole and the corresponding dehydro compounds and benzanellated systems. Other examples of basic heterocyclic radicals can be found in RD 36544 (September 1994), page 511.

Examples of a carbocyclic aromatic group represented by Ar or of an unsaturated heterocyclic ring represented by Ar include phenyl, naphthyl, furyl, thienyl and indolyl.

Examples of yellow filter dyes of formula I (oxonol dyes) include:

I-1

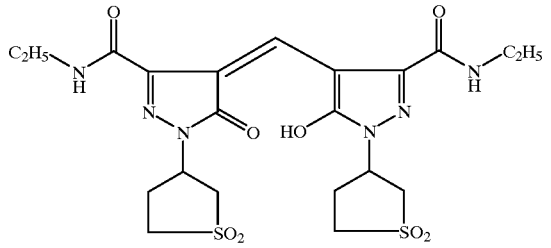

-continued

I-2

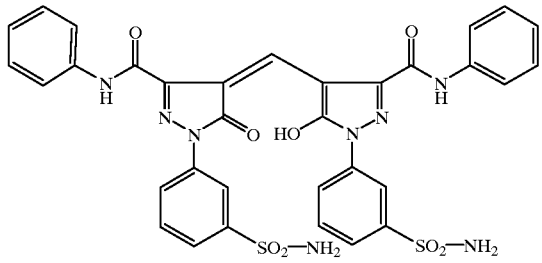

Examples of yellow filter dyes of formula II (merocyanine dyes) include:

II-1

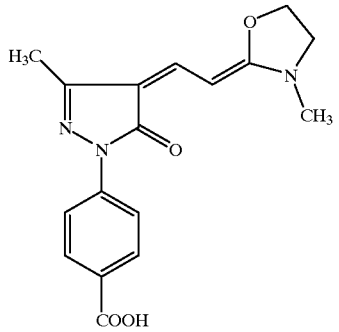

II-2

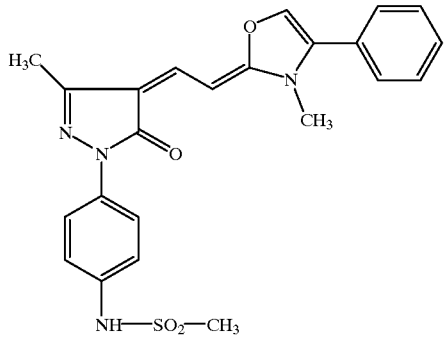

Examples of yellow filter dyes of formula III (arylidene dyes) include:

III-1

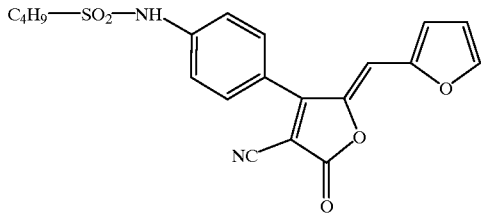

III-2

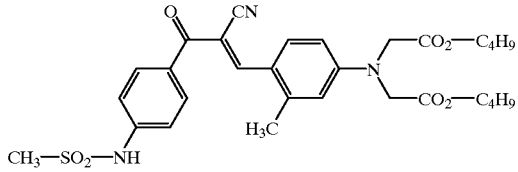

One example of a yellow filter dye of formula IV (azomethine dyes) is:

IV-1

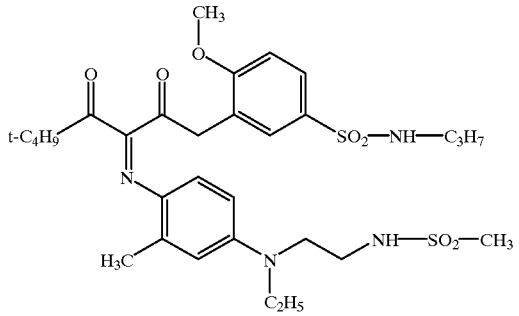

Examples of yellow filter dyes of formula V (azo dyes) include:

V-1

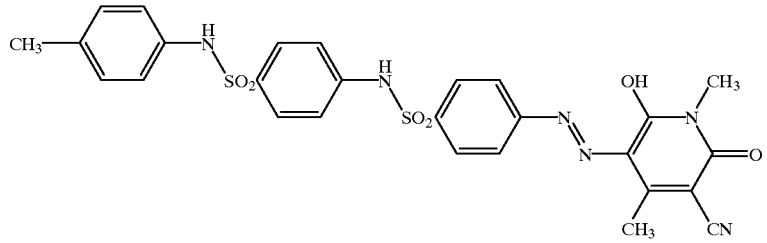

V-2

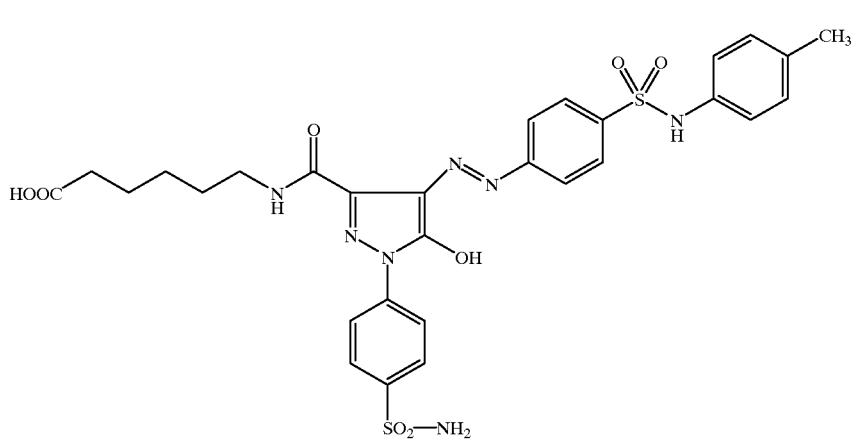

Particularly preferred examples of yellow filter dyes of formula II correspond to one of formulae VI and VII. In a preferred embodiment of the invention, the highest-sensitivity partial layer, which is furthest from the film base, of the green-sensitive silver halide emulsion layer therefore contains one or more dyes of one of formulae VI and VII (VI)

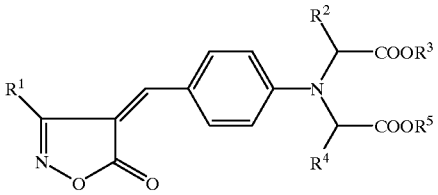

-continued (VII)

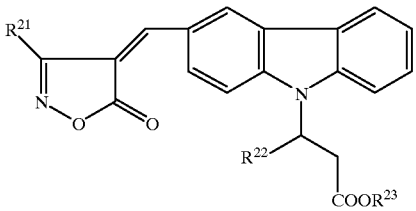

where:

$R^1$, $R^3$ and $R^5$ (independently of each other) represent alkyl, cycloalkyl or aryl;

$R^2$ and $R^4$ (independently of each other) represent hydrogen or alkyl;

$R^{21}$ represents group as defined for $R^1$ $R^{22}$ represents group as defined for $R^2$;

$R^{23}$ represents group as defined for $R^3$.

Examples of an alkyl group represented by $R^1$ to $R^5$ include methyl, ethyl, propyl, isopropyl, isobutyl, tert.-butyl or neopentyl. Said alkyl groups may be unsubstituted or substituted. Examples of a halogen as a substituent on one of said alkyl groups include fluorine, chlorine or bromine. Examples of an alkoxy group as a substituent on one of said alkyl groups include methoxy, ethoxy, propoxy, isopropoxy, isobutoxy, tert.-butoxy, neopentoxy, ethoxyethoxy or isobutoxyethoxy.

Examples of a sulphamoyl group as a substituent on one of said alkyl groups include N-tolylsulphamoyl or N-(1)-naphthylsulphamoyl. One example of a sulphonamido group as a substituent on one of said alkyl groups is tolylsulphonamido.

Examples of aryl as a substituent on one of said alkyl groups include phenyl, alkoxy-phenyl, alkylsulphonamidophenyl, N-alkylsulphonamoylphenyl, acylaminophenyl (the corresponding substituted alkyl groups are benzyl, p-propylsulphonamidobenzyl, p-propylsulphonamidophenethyl or -(p-N-alkylsulphamoylphenyl)-propyl, for example).

The dyes according to the invention may contain solubilising groupings comprising a dissociable proton, e.g.

—CO—OH

—NH—$SO_2$— (sulphamido or sulphamoyl)

—CO—NH—CO—, —CO—$NHSO_2$— or —$SO_2$NH—$SO_2$—.

Suitable dyes of formulae VI and VII which are particularly preferred, however, are those which have value of log P between spillover 2.0 and 7.0, preferably between spillover 2.5 and 6.5 (the value of log P is understood to mean the logarithm to the base 10 of the distribution coefficient P of a compound in the two-phase system n-octanol/water).

Yellow filter dyes of formulae VI and VII are described in DE 1 96 46 402, for example.

Examples of suitable yellow filter dyes of formulae VI and VII which can be used according to the invention in the highest-sensitivity partial layer of the green-sensitive silver halide emulsion layer unit are given below.

Examples of the yellow filter dyes of formulae VI and VII which are preferably used according to the invention are given below.

| Dye | $R^1$ | $R^2$ | $R^3$ | $R^4$ | $R^5$ | log P |
|---|---|---|---|---|---|---|
| VI-1 | —$C_3H_7$ | H | —$C_2H_5$ | H | —$C_2H_5$ | 2,8 |
| VI-2 | i-$C_3H_7$ | H | —$C_3H_7$ | H | —$C_3H_7$ | |
| VI-3 | —$C_3H_7$ | H | —$C_3H_7$ | H | —$C_3H_7$ | 3,2 |
| V1-4 | —$C_2H_5$ | —$CH_3$ | —$C_3H_7$ | H | —$C_3H_7$ | |
| VI-5 | —$C_3H_7$ | H | —$C_4H_9$ | H | —$C_4H_9$ | 4,2 |
| VI-6 | —$C_3H_7$ | H | —$(CH_2)_2$—$OC_2H_5$ | H | —$(CH_2)_2$—$OC_2H_5$ | 2,8 |
| VI-7 | —$C_2H_5$ | H | —$(CH_2)_2$—$OC_3H_7$ | H | —$(CH_2)_2$—$OC_3H_7$ | 3,0 |
| VI-8 | —$C_3H_7$ | H | —$CH_2CF_3$ | H | —$CH_2CF_3$ | |
| VI-9 | —$C_2H_5$ | H | —$C_3H_7$ | H | —$C_3H_7$ | 3,1 |
| VI-10 | —$C_3H_7$ | H | —$C_2H_5$ | H | i-$C_3H_7$ | |
| VI-11 | —$C_2H_5$ | H | i-$C_3H_7$ | H | i-$C_3H_7$ | |
| VI-12 | —$C_3H_7$ | H | —$(CH_2)_2$—$OC_4H_9$ | H | —$(CH_2)_2$—$OC_4H_9$ | 4,2 |
| VI-13 | —$CH_2$—$OCH_3$ | H | —$C_3H_7$ | H | —$C_3H_7$ | 2,9 |
| VI-14 | —$CH_2$—$OCH_3$ | H | —$(CH_2)_2$—$OC_6H_{13}$ | H | —$(CH_2)_2$—$OC_6H_{13}$ | 5,6 |
| VI-15 | —$CH_2$—$OCH_3$ | H | —$(CH_2)_2$—$OC_2H_5$ | H | —$(CH_2)_2$—$OC_2H_5$ | 2,0 |
| VI-16 | —$CH_2$—$OC_2H_5$ | H | —$C_3H_7$ | H | —$C_3H_7$ | 2,9 |
| VI-17 | —$CH_2$—$OC_2H_5$ | H | —$(CH_2)_2$—O—$(CH_2)_2$—$OC_4H_9$ | H | —$(CH_2)_2$—O—$(CH_2)_2$—$OC_4H_9$ | |
| VI-18 | —$CH_2$—$OC_2H_5$ | H | —$(CH_2)_2$—$OC_2H_5$ | H | —$(CH_2)_2$—$OC_2H_5$ | 2,5 |
| VI-19 | —$CH_2$—$OCH_3$ | —$CH_3$ | —$(CH_2)_2$—$OCH_3$ | —$CH_3$ | —$(CH_2)_2$—$OCH_3$ | |
| VI-20 | cyclohexyl | H | —$(CH_2)_2$—O—$C_2H_5$ | H | —$C_3H_7$ | 3,5 |
| VI-21 | 4-$C_6H_4$—NH—$SO_2C_4H_9$ | H | —$C_3H_7$ | H | —$C_3H_7$ | 3,4 |
| VI-22 | —$CH_2$—$C_6H_4$—NH—$SO_2C_2H_7$ | H | —$C_3H_7$ | H | —$C_3H_7$ | 3,0 |
| VI-23 | —$CH_2$—$C_6H_4$—NH—$SO_2$—$C_3H_7$ | H | —$(CH_2)_2$—O—$(CH_2)_2$—O—$CH_2CH(CH_3)_2$ | H | same as $R^3$ | |
| VI-24 | —$C_3H_7$ | H | —$(CH_2)_2$—O—$(CH_2)_2$—O—$CH_2CH(CH_3)_2$ | H | same as $R^3$ | 4,1 |
| VI-25 | —$C_3H_7$ | H | —$CH(CH_3)$—$CH_2$—O—$C_3H_7$ | H | same as $R^3$ | 4,3 |
| VI-26 | —$C_3H_7$ | H | —$(CH_2)_2$—O—$C(CH_3)_3$ | H | same as $R^3$ | 3,7 |
| VI-27 | —$CH_2$—$CH(CH_3)_2$ | H | —$(CH_2)_2$—O—$CH_2CH(CH_3)_2$ | H | same as $R^3$ | |
| VI-28 | —$CH_2$—$C(CH_3)_3$ | H | —$(CH_2)_2$—O—$C_3H_7$ | H | same as $R^3$ | |
| VI-29 | —$C_3H_7$ | H | —$(CH_2)_2$—$SO_2$—NH—$C_6H_4$—$CH_3$ | H | same as $R^3$ | 2,9 |
| VI-30 | —$C_3H_7$ | H | —$(CH_3)_3$—$SO_2$—NH— 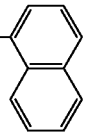 | H | same as $R^3$ | |
| VI-31 | —$C_3H_7$ | H | —$(CH_2)_2$—NH—$SO_2$—$C_6H_4$—$CH_3$ | H | same as $R^3$ | 2,9 |
| VI-32 | —$C_3H_7$ | H | —$(CH_2)_3$—NH—$SO_2$—$C_6H_4$—$CH_3$ | H | same as $R^3$ | 3,0 |

-continued

| Dye | $R^1$ | $R^2$ | $R^3$ | $R^4$ | $R^5$ | log P |
|---|---|---|---|---|---|---|
| VI-33 | $—C_3H_7$ | H | $—(CH_2)_2—C_6H_4—NH—SO_2—C_3H_7$ | H | same as R3 | 3,0 |
| VI-34 | $—C_3H_7$ | H | $—(CH_2)_2—C_6H_4—NH—SO_2—C_6H_5$ | H | same as R3 | 3,3 |

| Dye | $R^{21}$ | $R^{22}$ | $R^{23}$ | log P |
|---|---|---|---|---|
| VII-1 | $4\text{-}C_6H_4—NH—SO_2C_4H_9$ | H | $—C_2H_5$ | 4, 1 |
| VII-2 | $4\text{-}C_6H_4—NH—SO_2C_4H_9$ | H | $—(CH_2)_2—CH(CH_3)_2$ | 5, 8 |
| VII-3 | $—C_3H_7$ | H | $—C_4H_9$ | 5, 3 |
| VII-4 | $—C_2H_5$ | H | $—C_3H_7$ | |
| VII-5 | $—C_2H_5$ | $—CH_3$ | $—C_3H_7$ | |
| VII-6 | $4\text{-}C_6H_4—NH—SO_2C_3H_7$ | $—CH_3$ | $—C_2H_5$ | |
| VII-7 | $—CH_2—C_6H_4—NH—SO_2—CH_3$ | H | $—C_3H_7$ | |
| VII-8 | $—CH_2—C_6H_4—NH—SO_2—CH_3$ | $—CH_3$ | $—C_3H_7$ | |
| VII-9 | $—C_3H_7$ | H | $—(CH_2)_2—O—(CH_2)_2—O—CH_2—CH(CH_3)_2$ | 5, 2 |
| VII-10 | $—C_3H_7$ | H | $—(CH_2)_2O—(CH_2)_2—OC_2H_5$ | 4, 0 |
| VII-11 | $—(CH_2)_2—C_6H_5$ | H | $—(CH_2)_2—O—CH_2—CH(CH_3)_2$ | |
| VII-12 | $—(CH_2)_3—C_6H_5$ | H | $—(CH_2)_2—O—C_2H_5$ | |

In one preferred embodiment of the invention, the highest sensivity partial layer, which contains the organic yellow filter dye, of the green-sensitive silver halide emulsion layer unit contains a corresponding 2-equivalent magenta coupler as a colourless magenta coupler, and most preferably contains a 2-equivalent pyrazolone coupler. As is known, the advantages of using 2-equivalent colour couplers are that a lesser amount of exposed silver halide is necessary to produce a given amount of image dye than when corresponding 4-equivalent couplers are used. Examples of suitable 2-equivalent magenta couplers correspond to one of formulae VIII, IX, X and XI.

(VIII)

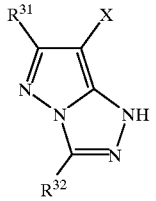

-continued (IX)

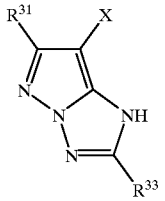

(X)

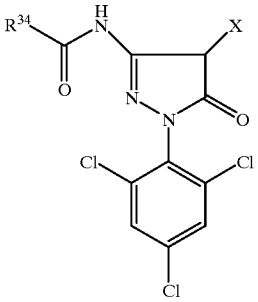

(XI)

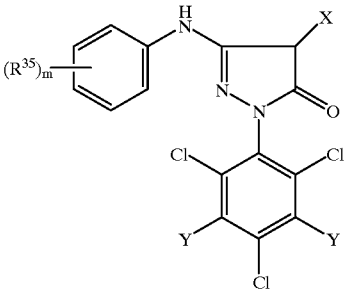

where:

X represents a radical which is different from hydrogen, e.g. a halogen atom or a group which can split off under chromogenic development conditions (volatile group);

$R^{31}$, $R^{32}$, $R^{33}$, $R^{34}$ (independently of each other) represent alkyl or aryl radicals which are optionally substituted;

$R^{35}$ represents any substituent;

m represents 0 (zero) or an integer from 1 to 5;

Y represents H or Cl.

The volatile groups represented by X include those groups, the essential function of which is to impart the behaviour of a 2-equivalent coupler to the magenta coupler, and those groups which, after separation from the coupler molecule, are themselves capable of intervening in the development operation (PUG—photographically useful group).

Examples of suitable 2-equivalent magenta couplers are given below.

M-1

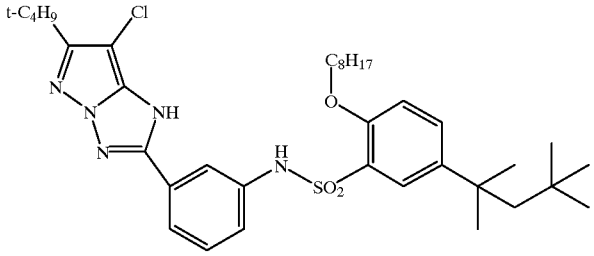

M-2

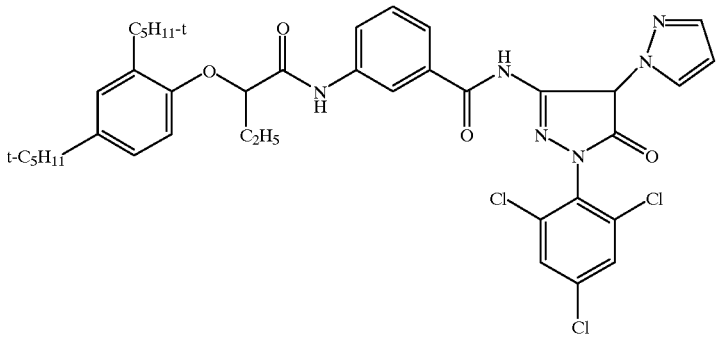

M-3

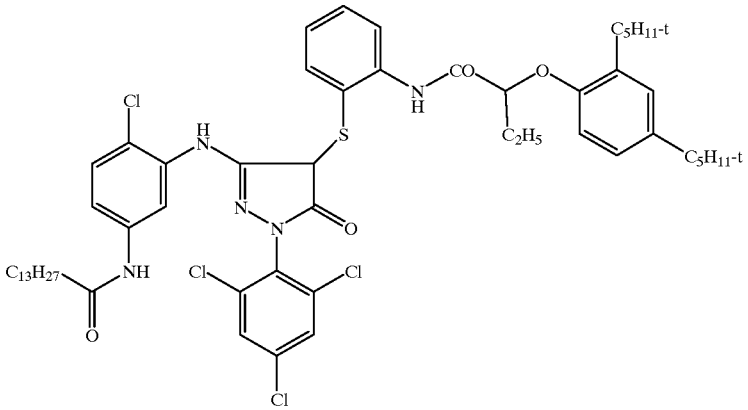

-continued
M-4
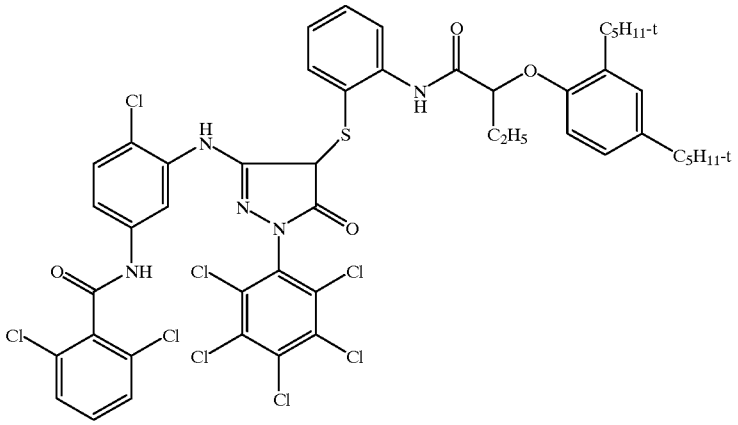
M-5
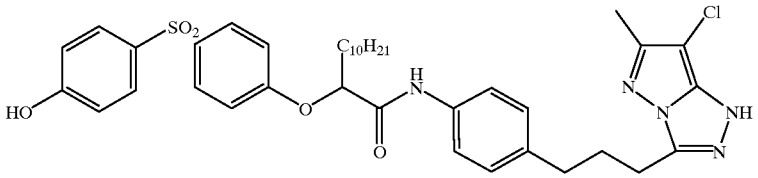
M-6
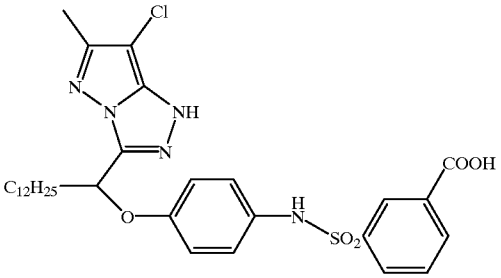
M-7
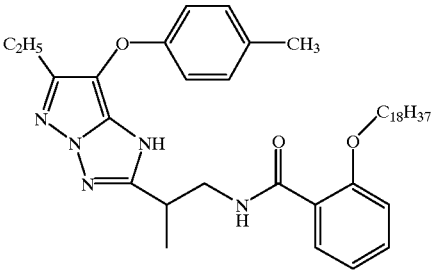
M-8
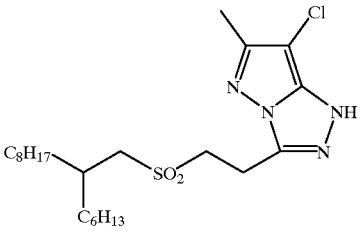

-continued

M-9

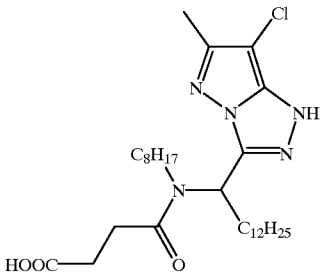

M-10

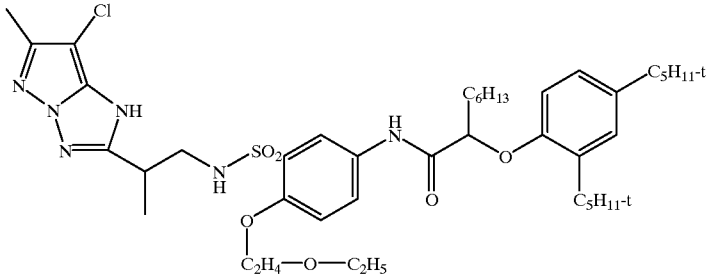

M-11

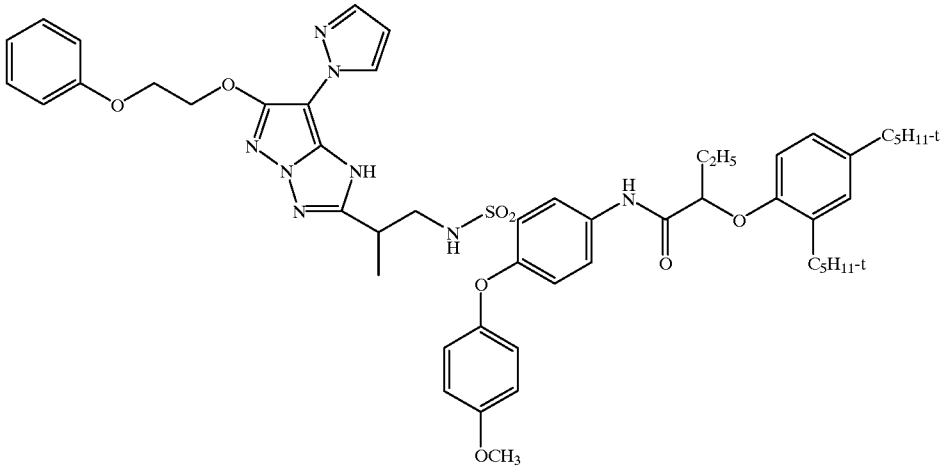

M-12

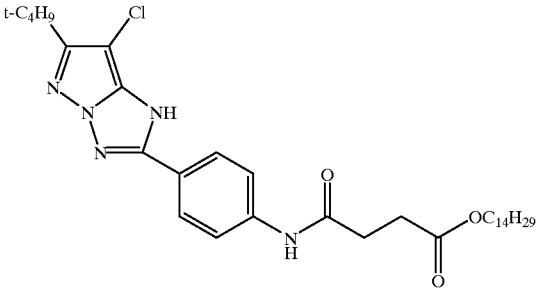

In addition to the aforementioned colourless colour couplers, the colour photographic recording material according to the invention also, as is customary, contains coloured couplers for masking unwanted secondary colour densities of the image dyes produced from the colour couplers on chromogenic development. These are generally yellow magenta couplers and/or yellow or red cyan couplers. It has been shown to be advantageous if at least part of the yellow colour coupler or colour couplers contained in the colour photographic recording material according to the invention is contained in the light-insensitive binder layer adjacent to the highest-sensitivity partial layer of the green-sensitive silver halide emulsion layer unit on the side remote from the film base.

Examples of suitable yellow couplers which, according to this preferred embodiment of the invention, may be contained in the light-insensitive binder layer situated between the green-sensitive and the blue-sensitive silver halide emulsion layer unit, correspond to one of formulae XII and XIII (XII)

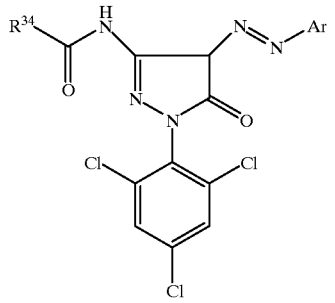

(XIII)

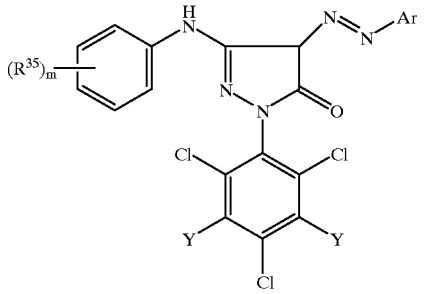

where $R^{34}$, $R^{35}$, m and Y have the same meaning as in formulae X and XI, and where Ar represents an aryl radical, which may optionally be substituted.

The colour photographic recording materials according to the invention comprise a transparent film base on which the various light-sensitive silver halide emulsion layers and light-insensitive layers are deposited. Thin films and sheet materials are particularly suitable as base materials. A review of base materials and of the auxiliary layers deposited on the front and back thereof is presented in Research Disclosure 37254, Part 1 (1995), page 285.

The possibilities for different layer arrangements and their effects on the photographic properties are described in J. Inf. Rec. Mats., 1994, Vol. 22, pages 183–193. The number and arrangement of the light-sensitive layers can be varied in order to obtain defined results. For example, high-sensitivity layers can be combined to form one stack of layers and low-sensitivity layers can be combined to form another stack of layers in a photographic film, in order to increase the film speed (DE-A-25 30 645). The essential constituents of the photographic emulsion layers are binders, silver halide grains and colour couplers.

Information on suitable binders can be found in Research Disclosure 37254, Part 2 (1995), page 286.

Information on suitable silver halide emulsions, and on their production, ripening, stabilisation and spectral sensitisation, including suitable spectral sensitisers, can be found in Research Disclosure 36544 (September 1994) and Research Disclosure 37254, Part 3 (1995), page 286, and in Research Disclosure 37038, Part XV (1995), page 89.

Photographic materials which exhibit camera sensitivity usually contain silver bromide-iodide emulsions which may also optionally contain small proportions of silver chloride.

Information on colour couplers can be found in Research Disclosure 37254, Part 4 (1995), page 288, and in Research Disclosure 37038, Part II (1995), page 80. The maximum absorption of the dyes formed from the couplers and the colour developer oxidation product preferably falls within the following ranges: yellow couplers 430 to 460 nm, magenta couplers 540 to 560 nm, cyan couplers 630 to 700 nm.

In order to improve film speed, granularity, sharpness and colour separation, compounds are frequently used in colour photographic films which on their reaction with the developer oxidation product form compounds which are photographically active, e.g. DIR couplers, which release a development inhibitor.

Information on compounds such as these, particularly couplers, can be found in Research Disclosure 37254, Part 5 (1995), page 290 and in Research Disclosure 37038, Part XIV (1995), page 86.

The colour couplers, which for the most part are hydrophobic, are usually dissolved or dispersed in high-boiling organic solvents, as are other hydrophobic constituents of the layers. These solutions or dispersions are then emulsified in an aqueous binder solution (usually a gelatine solution), and after the layers have been dried they are present in the layers as fine droplets (diameter 0.05 to 0.8 mm).

Suitable high-boiling organic solvents, methods of introducing a photographic material into the layers, and other methods of introducing chemical compounds into photographic layers, can be found in Research Disclosure 37254, Part 6 (1995), page 292.

The light-insensitive intermediate layers which are generally situated between layers of different spectral sensitivity may contain media which prevent the unwanted diffusion of developer oxidation products from one light-sensitive layer into another light-sensitive layer with a different spectral sensitisation.

Suitable compounds (white couplers, scavengers, or EOP scavengers) can be found in Research Disclosure 37254, Part 7 (1995), page 292, and in Research Disclosure 37038, Part III (1995), page 84.

The photographic material may also contain compounds which absorb UV light, optical brighteners, spacers, filter dyes, formalin scavengers, light stabilisers, anti-oxidants, $D_{min}$ dyes, additives to improve the dye-, coupler- and white stability and to reduce colour fogging, plasticisers (latices), biocides and other substances.

Suitable compounds can be found in Research Disclosure 37254, Part 8 (1995), page 292, and in Research Disclosure 37038, Parts IV, V, VI, VII, X, XI and XIII (1995), page 84 et seq.

The layers of photographic material are usually hardened, i.e. the binder which is used, preferably gelatine, is crosslinked by suitable chemical methods.

Suitable hardener substances can be found in Research Disclosure 37254, Part 9 (1995), page 294, and in Research Disclosure 37038, Part XII (1995), page 86.

After image-by-image exposure, photographic materials are processed by different methods according to their character. Details on these procedures and on the chemicals required for them are published in Research Disclosure 37254, Part 10 (1995), page 294, and in Research Disclosure 37038, Parts XVI to XXIII (1995), page 95 et seq., together with examples of materials.

In the colour photographic recording material according to the invention, the part of the composite layer structure which is situated above the highest-sensitivity green-sensitive silver halide emulsion layer has a layer thickness which is less than that of conventional, comparable recording materials. This situation has an advantageous effect on the sharpness of reproduction of the recording material, since the green-sensitive layers are the most important for imparting an impression of sharpness, and the sharpness of these layers is improved as light is scattered less in the layers situated above them during image-by-image exposure. In addition, the colour film according to the invention has a very good breaking strength and exhibits very good dry adhesion of the layer structure. The sensitometric stability of the film when stored in a hot, humid climate is also very good.

EXAMPLE 1

A colour photographic recording material for colour negative development was produced (sample 1.1—comparison) by depositing the following layers, in the given sequence, on a transparent film base of cellulose triacetate which had a thickness of 120 $\mu$m and which was provided with an adhesion layer. The amounts are given in g/m$^2$. The corresponding amounts of $AgNO_3$ are given for the silver halide deposition. All the silver halide emulsions were stabilised with 0.1 g 4-hydroxy-6-methyl-1,3,3a,7-tetraazaindene per 100 g $AgNO_3$. The silver halide emulsions are characterised by their halide composition, and are characterised as regards grain size by the volume weighted mean value of the grain size distribution (VSP or $d_v$). The VSP has the dimensions of length [$\mu$m] and is determined via the relationship $$VSP = \bar{d}_v = \frac{\sum n_i d_i^4}{\sum n_i d_i^3}$$

where $n_i$ denotes the number of particles in interval i and $d_i$ denotes the diameter of the spheres of equivalent volume to the particles in interval i.

| Test specimen 1.1 | |
|---|---|
| Layer 1: (anti-halo layer) | |
| dye XF-1 | 0.12 |
| dye XF-2 | 0.12 |
| gelatine | 0.8 |
| Layer 2: (low-sensitivity red-sensitised layer) | |
| red-sensitised silver bromide-iodide-chloride emulsion (2.4 mole % iodide; 10.5 mole % chloride; VSP 0.35) | 0.85 |
| gelatine | 0.6 |
| cyan coupler XC-1 | 0.3 |
| coloured coupler XCR-1 | $2.0 \times 10^{-2}$ |
| coloured coupler XCY-1 | $1.0 \times 10^{-2}$ |
| DIR coupler XDIR-1 | $1.0 \times 10^{-2}$ |
| Layer 3: (medium-sensitivity red-sensitised layer) | |
| red-sensitised silver bromide-iodide emulsion (10.0 mole % iodide; VSP 0.56) | 1.2 |
| gelatine | 0.9 |
| cyan coupler XC-1 | 0.2 |
| coloured coupler XCR-1 | $7.0 \times 10^{-2}$ |
| coloured coupler XCY-1 | $3.0 \times 10^{-2}$ |
| DIR coupler XDIR-1 | $4.0 \times 10^{-3}$ |
| Layer 4: (high-sensitivity red-sensitised layer) | |
| red-sensitised silver bromide-iodide emulsion (6.8 mole % iodide; VSP 1.2) | 1.6 |
| gelatine | 1.2 |
| cyan coupler XC-2 | 0.15 |
| DIR coupler XDIR-3 | $3.0 \times 10^{-2}$ |
| Layer 5: (intermediate layer) | |
| dye XF-3 | 0.12 |
| gelatine | 1.0 |
| Layer 6: (low-sensitivity green-sensitised layer) | |
| green-sensitised silver bromide-iodide-chloride emulsion (9.5 mole % iodide; 10.4 mole % chloride; VSP 0.5) | 0.85 |
| gelatine | 0.9 |
| magenta coupler XM-1 | 0.3 |
| coloured coupler XMY-l | $2.0 \times 10^{-2}$ |

-continued

| Test specimen 1.1 | |
|---|---|
| DIR coupler XDIR- 1 | $5.0 \times 10^{-3}$ |
| DIR coupler XDIR-2 | $1.0 \times 10^{-3}$ |
| oxform scavenger XSC-1 | $5.0 \times 10^{-2}$ |
| Layer 7: (medium-sensitivity green-sensitised layer) | |
| green-sensitised silver bromide-iodide emulsion (10.0 mole % iodide; VSP 0.56) | 1.4 |
| gelatine | 0.9 |
| magenta coupler XM-1 | 0.24 |
| coloured coupler XMY-1 | $4.0 \times 10^{-2}$ |
| DIR coupler XDIR-1 | $5.0 \times 10^{-3}$ |
| DIR coupler XDIR-2 | $3.0 \times 10^{-3}$ |
| Layer 8: (high-sensitivity green-sensitised layer) | |
| green-sensitised silver bromide-iodide emulsion (6.8 mole % iodide; VSP 1.1) | 1.7 |
| gelatine | 1.2 |
| magenta coupler XM-2 | $3.0 \times 10^{-2}$ |
| coloured coupler XMY-2 | $5.0 \times 10^{-2}$ |
| DIR coupler XDIR-3 | $5.0 \times 10^{-2}$ |
| Layer 9: (yellow filter layer) | |
| yellow colloidal silver sol (silver filter yellow), Ag | 0.1 |
| gelatine | 0.8 |
| polyvinylpyrrolidone | 0.2 |
| oxform scavenger XSC-2 | $6.0 \times 10^{-2}$ |
| Layer 10: (low-sensitivity blue-sensitised layer) | |
| blue-sensitised silver bromide-iodide-chloride emulsion (6.0 mole % iodide; VSP 0.78) | 0.4 |
| gelatine | 1.0 |
| yellow coupler XY-1 | 0.4 |
| DIR coupler XDIR-1 | $3.0 \times 10^{-2}$ |
| Layer 11: (medium-sensitivity blue-sensitised layer) | |
| blue-sensitised silver bromide-iodide emulsion (8.8 mole % iodide; 15.0 mole % chloride; VSP 0.77) | 0.12 |
| (12.0 mole % iodide; 15.0 mole % chloride: VSP 1.0) | 0.28 |
| gelatine | 0.77 |
| yellow coupler XY-1 | 0.58 |
| Layer 12: (high-sensitivity blue-sensitised layer) | |
| blue-sensitised silver bromide-iodide emulsion (12.0 mole % iodide; VSP 1.2) | 1.2 |
| gelatine | 0.9 |
| yellow coupler XY-1 | 0.1 |
| DIR coupler XDIR-3 | $2.0 \times 10^{-2}$ |
| Layer 13: (protective layer) | |
| micrate silver bromide-iodide emulsion (4.0 mole % iodide; VSP 0.05) | 0.25 |
| UV absorber XUV-1 | 0.2 |
| UV absorber XUV-2 | 0.3 |
| gelatine | 1.4 |
| Layer 14: (hardening layer) | |
| gelatine | 0.2 |
| hardening agent XH-1 | 0.86 |
| Persoftal | 0.04 |

The following compounds were used in Example 1:

XF-1
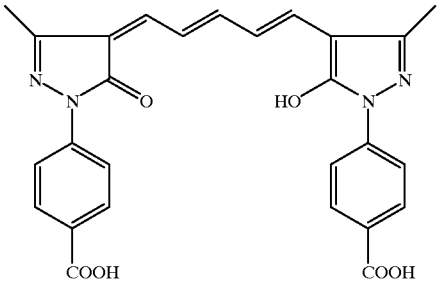
XF-2
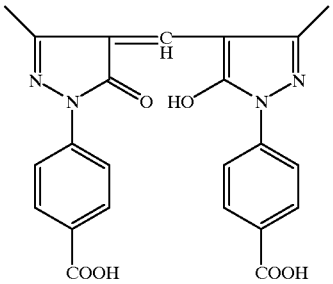
XF-3
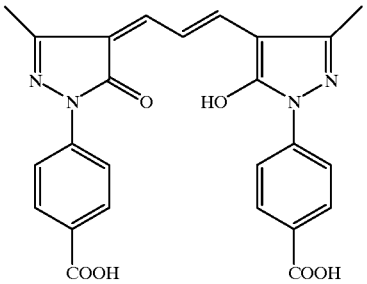
XC-1
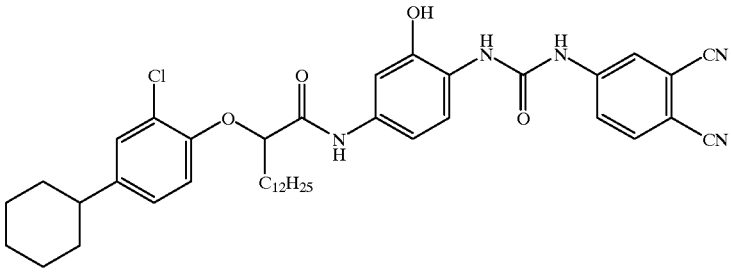
XC-2
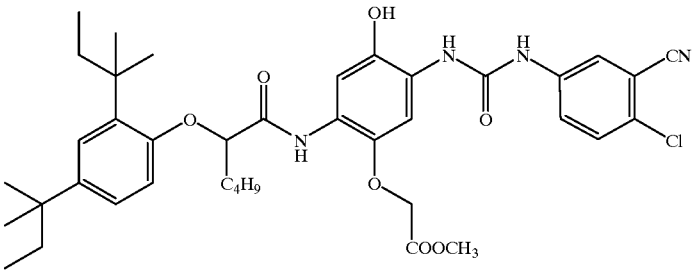

-continued
XCR-1
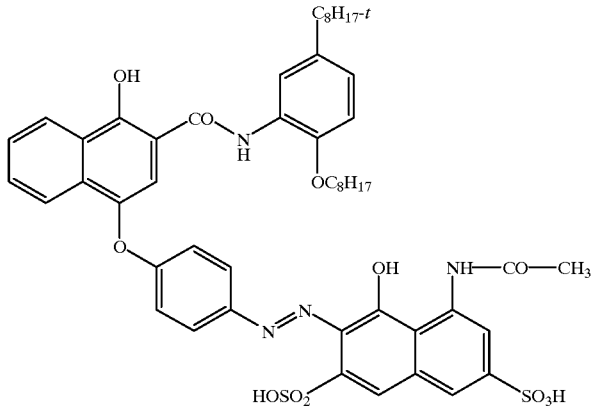
XCY-1
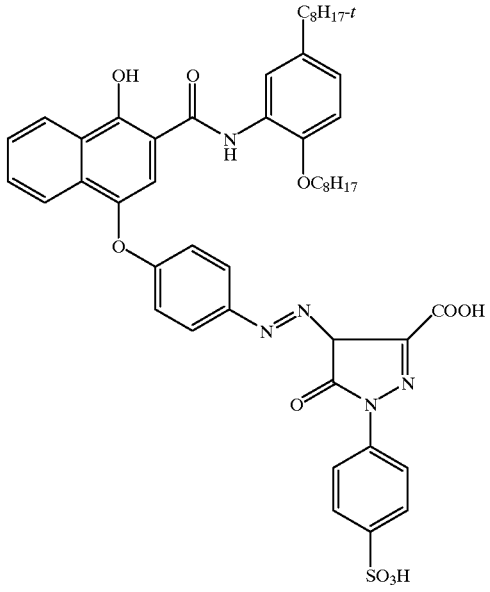
XM-1
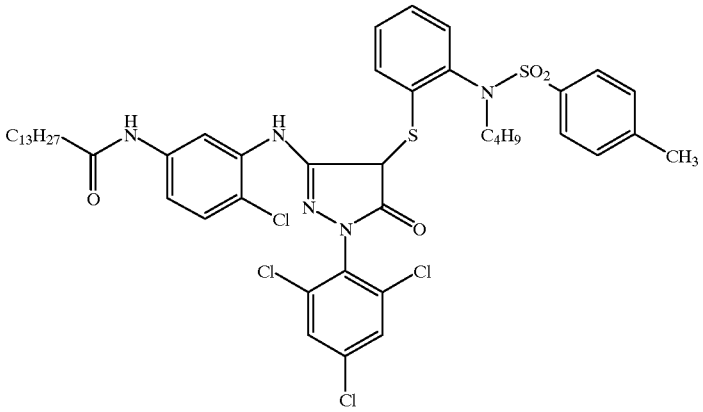

-continued
XM-2
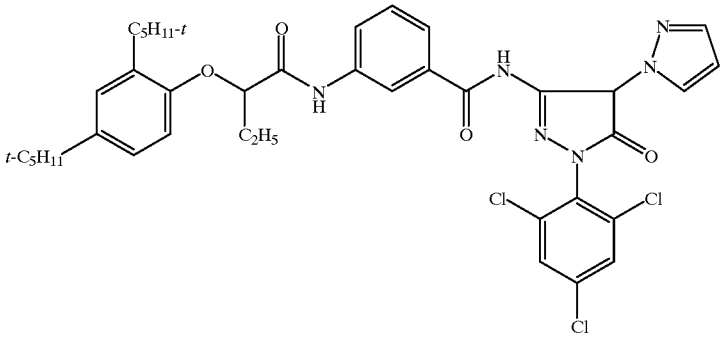
XMY-1
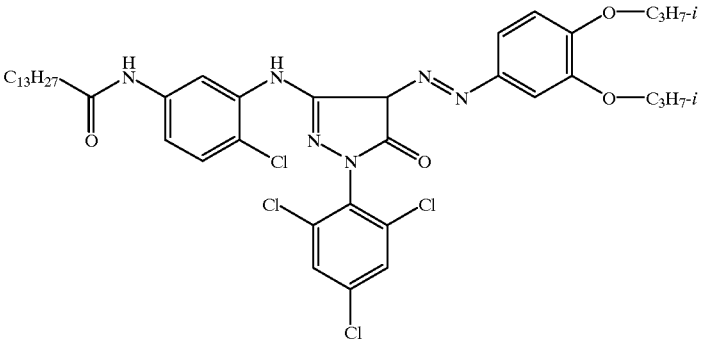
XMY-2
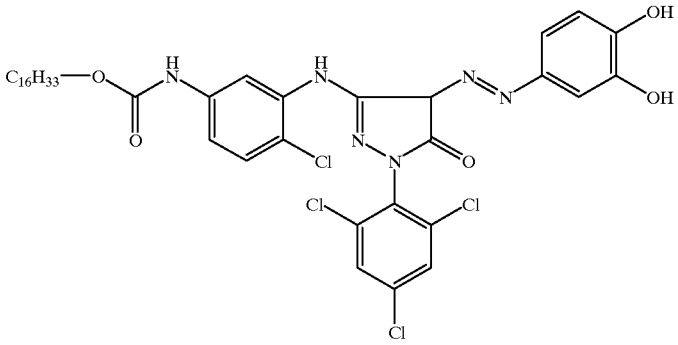
XY-1
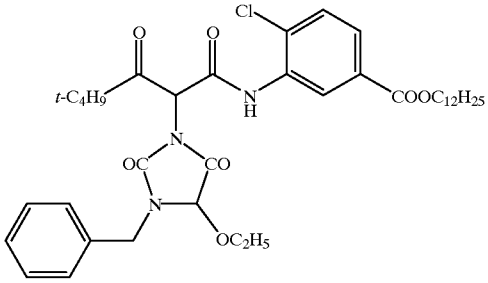

-continued
XDIR-1
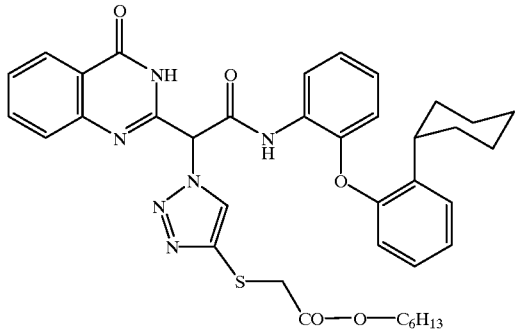
XDIR-2
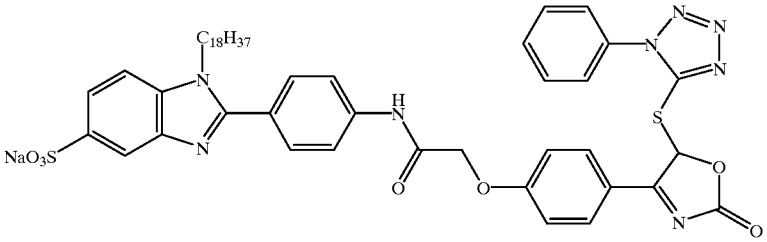
XDIR-3
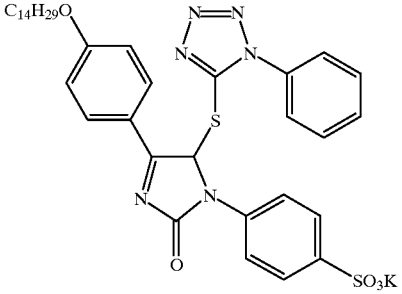
XSC-1
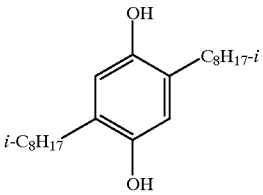
XUV-1
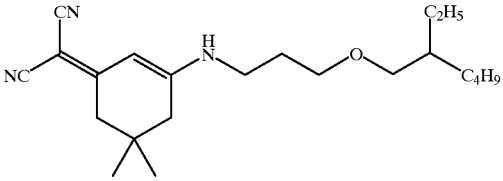

-continued

XUV-2

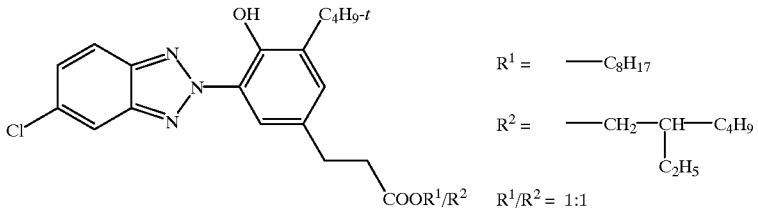

XH-1

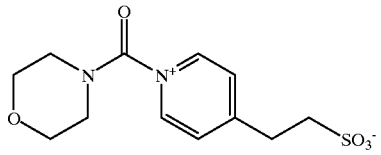

The colourless and coloured couplers were each incorporated, together with the same amount of tricresyl phosphate (TCP), by emulsification methods known in the art.

Test specimen 1.2—comparison

Test specimen 1.2 only differed from test specimen 1.1 in that in layer 9 (the yellow filter layer) it contained 0.07 g of dye VI-3 instead of colloidal silver and only contained 0.4 g gelatine instead of 0.8 g gelatine.

| Layer 9: (yellow filter layer) | |
|---|---|
| dye VI-3 | $7.0 \times 10^{-2}$ |
| gelatine | 0.4 |
| polyvinylpyrrolidone | 0.2 |
| oxform scavenger XSC-2 | $6.0 \times 10^{-2}$ |

Test specimens 1.3 to 1.9—comparison

Test specimens 1.3 to 1.9 only differed from test specimen 1.2 in that in layer 9 (the yellow filter layer) they contained another of the dyes listed in Table 1, in the amount given in each case, instead of 0.07 g of dye VI-3.

Test specimens 1.10 to 1.17—according to the invention

Test specimens 1.10 to 1.17 only differed from test specimens 1.2 to 1.9 in that the respective dyes were not added to layer 9 but were added to layer 8. Test specimens 1.2 and 1.10, 1.3 and 1.11, 1.4 and 1.12 . . . etc., therefore had the same overall composition.

The following tests were performed on the test specimens a) tropical climate test cabinet b) green MÜF at 40 LP/mm c) dry adhesion d) wet adhesion The results are shown in Table 1. The MUF values, like the sensitivities, are not absolute but are given with reference to comparison test specimen 1.1. $E_{blue}$ denotes the change in blue-sensitivity after storing the unexposed test specimen at 80% relative humidity and 50° C. for 7 days.

| Test specimen | | Dye | Amount [g] | Layer | $E_{blue}$ | $E_{green}$ | $\Delta E_{blue}$ | MÜF | Adhesion (dry) | Adhesion (wet) |
|---|---|---|---|---|---|---|---|---|---|---|
| 1.1 | comparison | colloidal silver | | 9 | 100 | 100 | −2.3 | 100 | in order | in order |
| 1.2 | comparison | VI-3 | 0.70 | 9 | 98 | 100 | −3.2 | 108 | unsatisfactory | prohibitively poor |
| 1.3 | comparison | VI-5 | 0.75 | 9 | 99 | 99 | −2.7 | 107 | unsatisfactory | prohibitively poor |
| 1.4 | comparison | VI-24 | 1.03 | 9 | 97 | 100 | −2.2 | 108 | unsatisfactory | prohibitively poor |
| 1.5 | comparison | VI-32 | 1.25 | 9 | 98 | 98 | −1.5 | 106 | unsatisfactory | prohibitively poor |
| 1.6 | comparison | VII-9 | 1.14 | 9 | 100 | 99 | −2.3 | 109 | unsatisfactory | prohibitively poor |
| 1.7 | comparison | VII-10 | 1.08 | 9 | 99 | 97 | −2.5 | 108 | unsatisfactory | prohibitively poor |
| 1.8 | comparison | III-1 | 0.93 | 9 | 98 | 99 | −3.5 | 109 | unsatisfactory | prohibitively poor |
| 1.9 | comparison | III-2 | 1.36 | 9 | 100 | 100 | −2.4 | 110 | unsatisfactory | prohibitively poor |
| 1.10 | invention | VI-3 | 0.70 | 8 | 99 | 98 | −0.8 | 110 | in order | in order |
| 1.11 | invention | VI-5 | 0.75 | 8 | 100 | 102 | −0.7 | 109 | in order | in order |
| 1.12 | invention | VI-24 | 1.03 | 8 | 100 | 104 | −0.6 | 111 | in order | in order |
| 1.13 | invention | VI-32 | 1.25 | 8 | 101 | 101 | −0.4 | 108 | in order | in order |
| 1.14 | invention | VII-9 | 1.14 | 8 | 99 | 103 | −0.6 | 110 | in order | in order |
| 1.15 | invention | VII-10 | 1.08 | 8 | 100 | 102 | −0.7 | 109 | in Ordnung | in order |
| 1.16 | invention | III-1 | 0.93 | 8 | 98 | 102 | −1.0 | 107 | in Ordnung | in order |
| 1.17 | invention | III-2 | 1.36 | 8 | 99 | 103 | −0.6 | 110 | in Ordnung | in order |

It can be seen from Table 1 that the improvement in sharpness is achieved without disadvantages for the mechanical properties of the layers, and that the stability on storage in a tropical climate is considerably improved in addition. Surprisingly, these advantages were obtained without disadvantages for the colour reproduction. These effects could not have been foreseen.

We claim:

1. A color photographic recording material comprising a transparent film base, a red-sensitive silver halide emulsion layer unit with which at least one colorless cyan coupler is associated, a green-sensitive silver halide emulsion layer unit with which at least one colorless magenta coupler is associated, a blue-sensitive silver halide emulsion layer unit with which at least one colorless yellow coupler is associated, and optionally further light-insensitive layers, wherein said red-sensitive silver halide emulsion layer unit and said blue-sensitive silver halide emulsion layer unit have partial layers and wherein the green-sensitive silver halide emulsion layer unit comprises at least two-green sensitive partial layers, the partial layer of which is furthest from the film base has the highest sensitivity and is situated further from the film base than is each partial layer of said red-sensitive silver halide emulsion layer unit, and wherein each partial layer of said blue-sensitive silver halide emulsion layer unit is situated further from the film base than is the highest-sensitivity partial layer of the green-sensitive silver halide emulsion layer unit and wherein the highest-sensitivity partial layer of the green-sensitive silver halide emulsion layer unit contains at least one organic yellow dye which can be decolorized during processing.

2. The recording material according to claim 1, which further contains a light-insensitive binder, which contains no silver halide development nuclei and substantially no dye which can be decolorized during processing, is adjacent to the highest-sensitivity partial layer of the green-sensitive silver halide emulsion layer unit on the side remote from the film base.

3. The recording material according to claim 2, wherein said at least one organic yellow dye is selected from the group consisting of

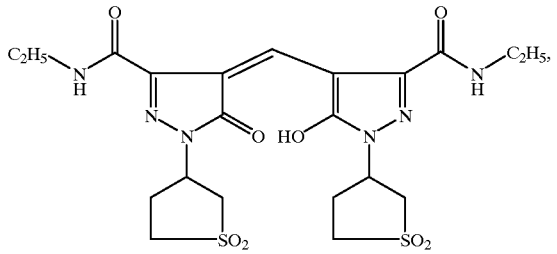

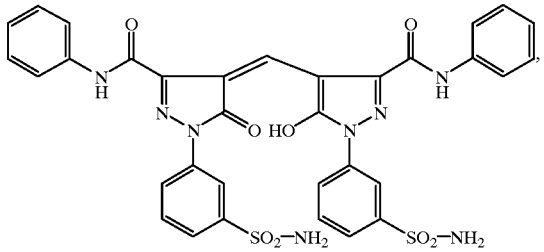

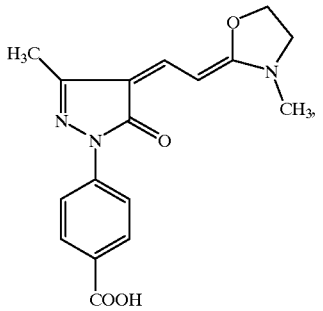

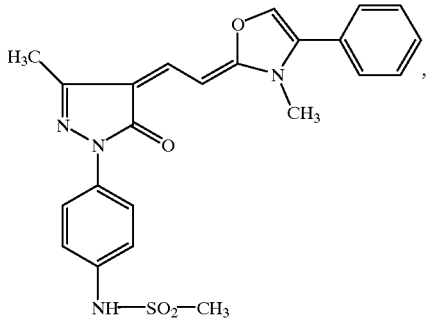

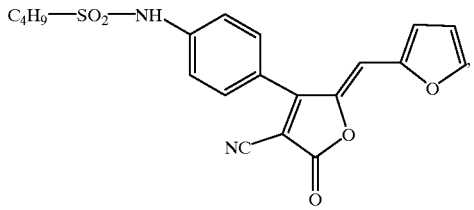

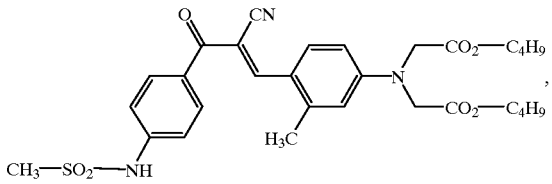

-continued
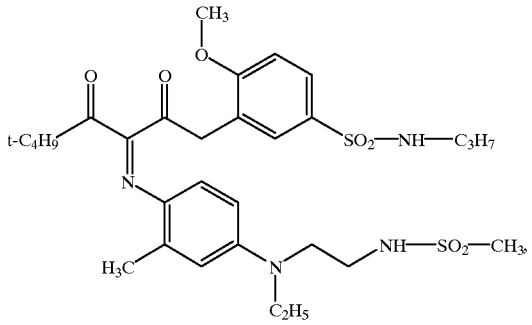
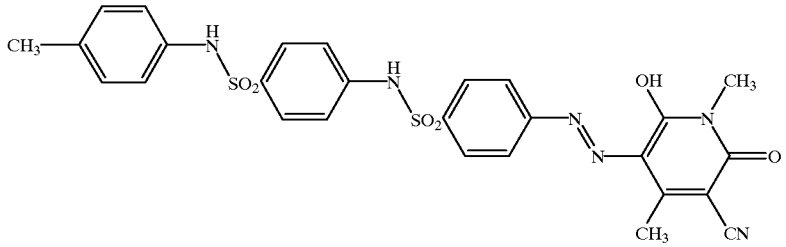
and
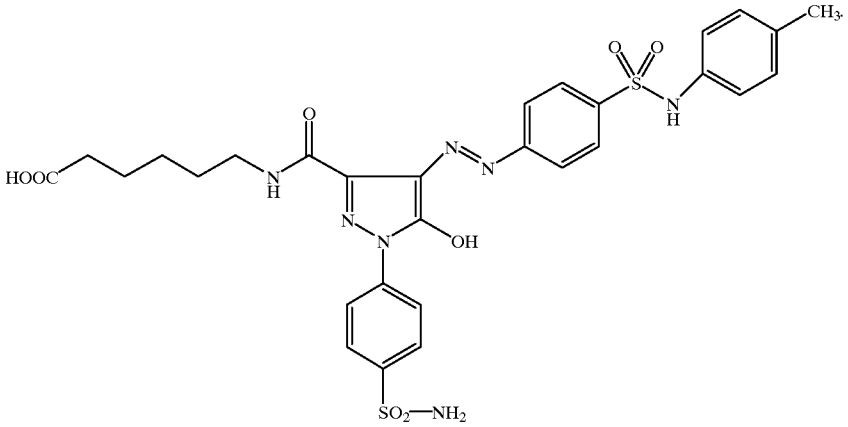
4. The recording material according to claim 1, wherein the organic yellow dye which is decolorizeable during processing corresponds to formula VI or VII
(VI)
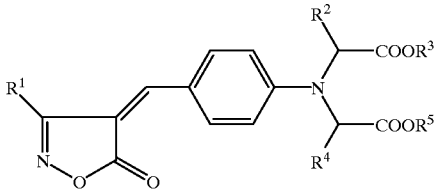
-continued
(VII)
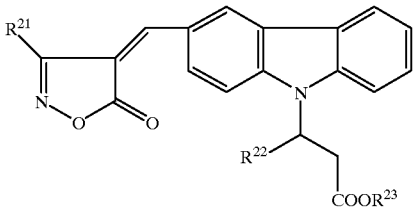
where $R^1$, $R^3$ and $R^5$ (independently of each other) represent a substituted alkyl, an unsubstituted alkyl, a substituted cycloalkyl, an unsubstituted cycloalkyl a substituted aryl or unsubstituted aryl, wherein the substituents for the alkyl, cycloalkyl and aryl are halogen, alkoxy, sulphamoyl, sulphonamido or aryl, $R^2$ and $R^4$ (independently of each other) represent hydrogen or a substituted alkyl or unsubstituted alkyl, wherein the substituents on the alkyl are halogen, alkoxy, sulphamoyl,sulphonamido or aryl;

$R^{21}$ represents the group as defined for $R^1$;

$R^{22}$ represents the group as defined for $R^2$; and $R^{23}$ represents group as defined for $R^3$.

5. The recording material according to claim 4, wherein the organic yellow dye which is decolorizable during processing, corresponding to one of the formulae VI and VII, has a value of logP between 2.0 and 7.0.

6. The recording material according to claim 5, wherein the organic yellow dye which is decolorizable during processing, corresponding to one of the formulae VI and VII, has a value of logP between 2.5 and 6.5.

7. The recording material according to claim 4, wherein $R^2$ is hydrogen or $CH_3$ and $R^4$ is hydrogen or —$CH_3$.

8. The recording material as claimed in claim 7, wherein $R^3$ and $R^5$ are identical.

9. The recording material according to claim 4, wherein $R^2$ and $R^4$ are hydrogen.

10. The recording material according to claim 4, wherein the dye is a formula VII and $R^{22}$ is hydrogen or —$CH_3$.

11. The recording material according to claim 10, wherein $R^{22}$ represents H.

12. The recording material according to claim 1, wherein the highest-sensitivity partial layer of the green-sensitive silver halide emulsion layer unit contains a 2-equivalent pyrazolone coupler as a colorless magenta coupler.

13. The recording material according to claim 1, wherein said recording material does not contain a yellow filter layer.

14. The recording material according to claim 1, wherein said recording material is a color negative film.

15. The recording material according to claim 1, wherein said at least one organic dye has an absorption maximum between 400 nm and 500 nm.

16. The recording material according to claim 15, wherein said organic yellow dye is at least one dye of the formula I, II, III, VI and V $$A^1{=}L^1{-}A^2 \quad \text{(I)}$$

$$A^1{=}L^1{-}L^2{=}B^1 \quad \text{(II)}$$

$$A^1{=}L^1{-}Ar \quad \text{(III)}$$

$$A^1{=}N{-}Ar \quad \text{(IV)}$$

$$A^1{-}N{=}N{-}Ar \quad \text{(V)}$$

where $A^1$ and $A^2$ are identical or different and are acidic radicals;

$B^1$ is a basic heterocyclic radical;

Ar is a carboxylic aromatic group or an unsubstituted heterocyclic ring; and $L^1$ and $L^2$ are identical or different and are unsubstituted or substituted methine groups.

* * * * *